US007357089B1

(12) United States Patent
Chang

(10) Patent No.: US 7,357,089 B1
(45) Date of Patent: Apr. 15, 2008

(54) AUTOMATIC THREAD CUTTING DEVICE FOR SEWING MACHINE

(76) Inventor: Tseng Hsien Chang, 1F, No. 11, Lane 125, Sec. 1, Kuo Kuang Road, Ta-Li City, Taichung Hsien (TW) 412

( * ) Notice: Subject to any disclaimer, the term of this patent is extended or adjusted under 35 U.S.C. 154(b) by 0 days.

(21) Appl. No.: 11/595,873

(22) Filed: Nov. 13, 2006

(51) Int. Cl.
*D05B 65/00* (2006.01)
*D05B 65/02* (2006.01)

(52) U.S. Cl. ..... 112/285

(58) Field of Classification Search ..... 112/285, 112/288, 289, 291, 295, 296, 298, 300; 74/640, 74/724, 421 R
See application file for complete search history.

(56) References Cited

U.S. PATENT DOCUMENTS 3,704,527 A * 12/1972 Berkman ..... 434/401
3,756,177 A * 9/1973 Landwehr ..... 112/289
3,894,502 A * 7/1975 Hager et al. ..... 112/289
4,256,048 A * 3/1981 Jung ..... 112/292
6,725,794 B2 * 4/2004 Usa ..... 112/292
7,178,427 B2 * 2/2007 Christensen ..... 74/640

* cited by examiner

*Primary Examiner*—Ismael Izaguirre
(74) *Attorney, Agent, or Firm*—Banger Shia

(57) ABSTRACT

The present invention is an automatic thread cutting device for a sewing machine, which is equipped with an automatic thread cutting device on the position that a needle thread passes through. The automatic thread cutting device comprises a main body that is equipped with a worm gear rod of active piece actuated by a motor of driving piece, wherein the active piece is engaged with a worm gear denture of passive piece that motivates a thread hooking member, a knife base with a knife is fixed on the main body and cooperates with the thread hooking member to cut a needle thread. Thus the size of the whole device can be minimized effectively to fit in the small space of a sewing machine, and then the objective of effort-saving and fast thread cutting is attained.

19 Claims, 6 Drawing Sheets

AUTOMATIC THREAD CUTTING DEVICE FOR SEWING MACHINE

FIELD OF THE INVENTION

The present invention relates to an automatic thread cutting device for a sewing machine, and more particularly to a thread cutting device to cut a needle thread of a sewing machine, wherein a driving piece actuates a passive piece and an interlocking piece, the interlocking piece can be guided linearly by cooperating with a guiding structure and move quickly, and then the objective of exact control and optimal efficiency on thread cutting can be attained.

BACKGROUND OF THE INVENTION

As per the conventional thread cutting device of a sewing machine, there are many prior arts, for example, TW Appl. No. 85203813, 86218218, 89207548, 89214516, 89214905, 91218393, 92129042, 94204676 and 95200698, which all use a linear actuator to actuate a connecting rod mechanism to make a thread hooking member stretch out or retract, however such mechanism has the following shortcomings, which are:

1. The whole structure is too complicated and large: the prior art used a linear actuator to control a thread hooking member back and forth, because the linear distance of the actuator is limited, therefore it must have a lever arm that the effort arm is a lot shorter than the load arm to be an active component to amplify the distance of the movement of the thread hooking member, so the distance for the thread hooking member moving back and forth can be satisfied, this type of structure has a large size due to the length of the lever arm, it is hard to comply with the necessary of miniaturization and simplification.

2. The mistake of the linear actuator is easy to get amplified: because the lever arm amplifies the moving distance, therefore any of the components has a mistake which will be amplified due to the long lever arm, which causes the thread hooking member short moving distance or over moving distance, the thread hooking member would be unable to cut the needle thread or over stretched then hit the corresponding components or structure and get damaged, so it needs to be improved.

3. Force-consuming structure is not economical: because the load arm is longer than the effort arm, which is a force-consuming structure that will consume improperly electricity and the actuator is easy to get damaged, therefore it needs to be improved.

SUMMARY OF THE INVENTION

It is an objective of the present invention to provide an automatic thread cutting device for a sewing machine that is capable to cut the needle thread exactly and get better efficiency in speed.

The main objective of the present invention is to provide an automatic thread cutting device for a sewing machine, wherein the main body is equipped with a worm gear rod of active piece actuated by a motor of driving piece, with the design of a passive piece engaged with the active piece, and an interlocking piece being coaxial with the passive piece and swinging together therewith, therefore the thread hooking member on the end of the interlocking piece can be motivate exactly. Thus the present invention can save energy and be minimized on the size to promote the ability of thread cutting and the quality of work.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
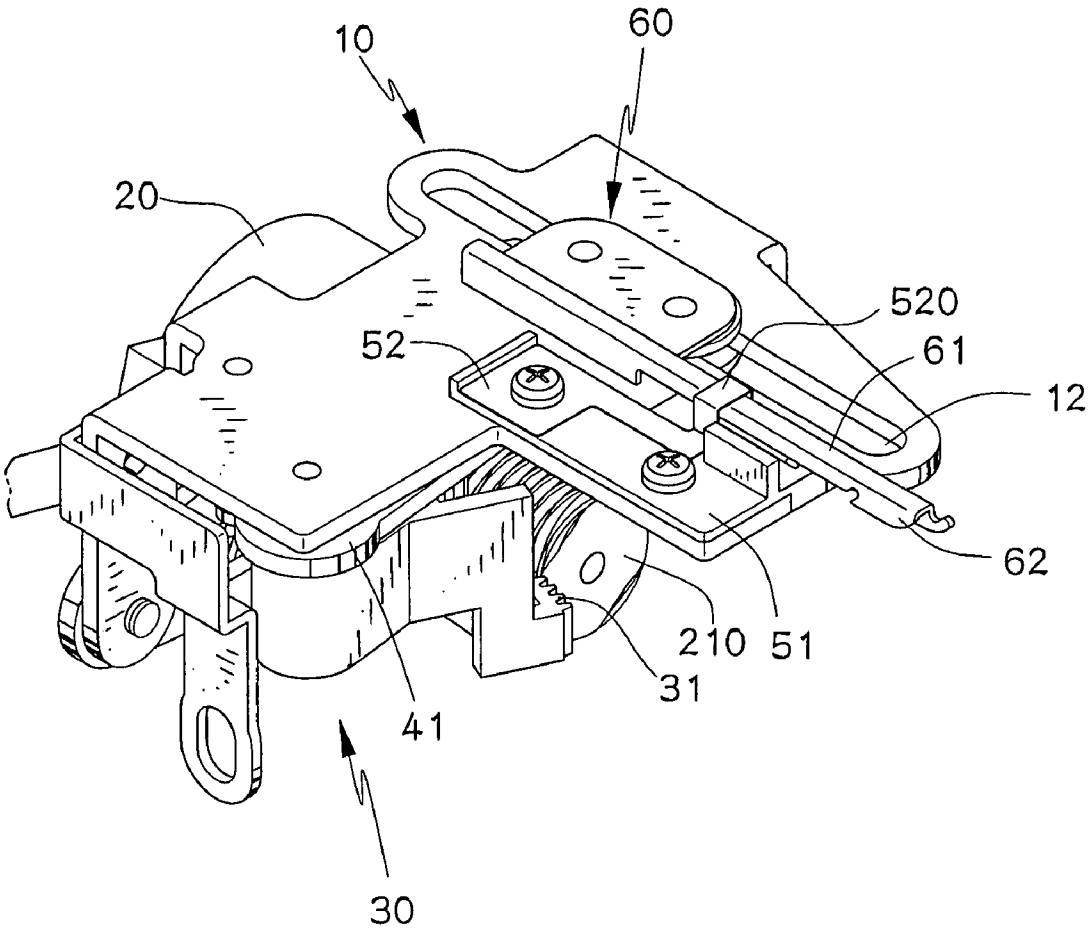
FIG. 1 is a perspective view of the present invention.
Figure 2:
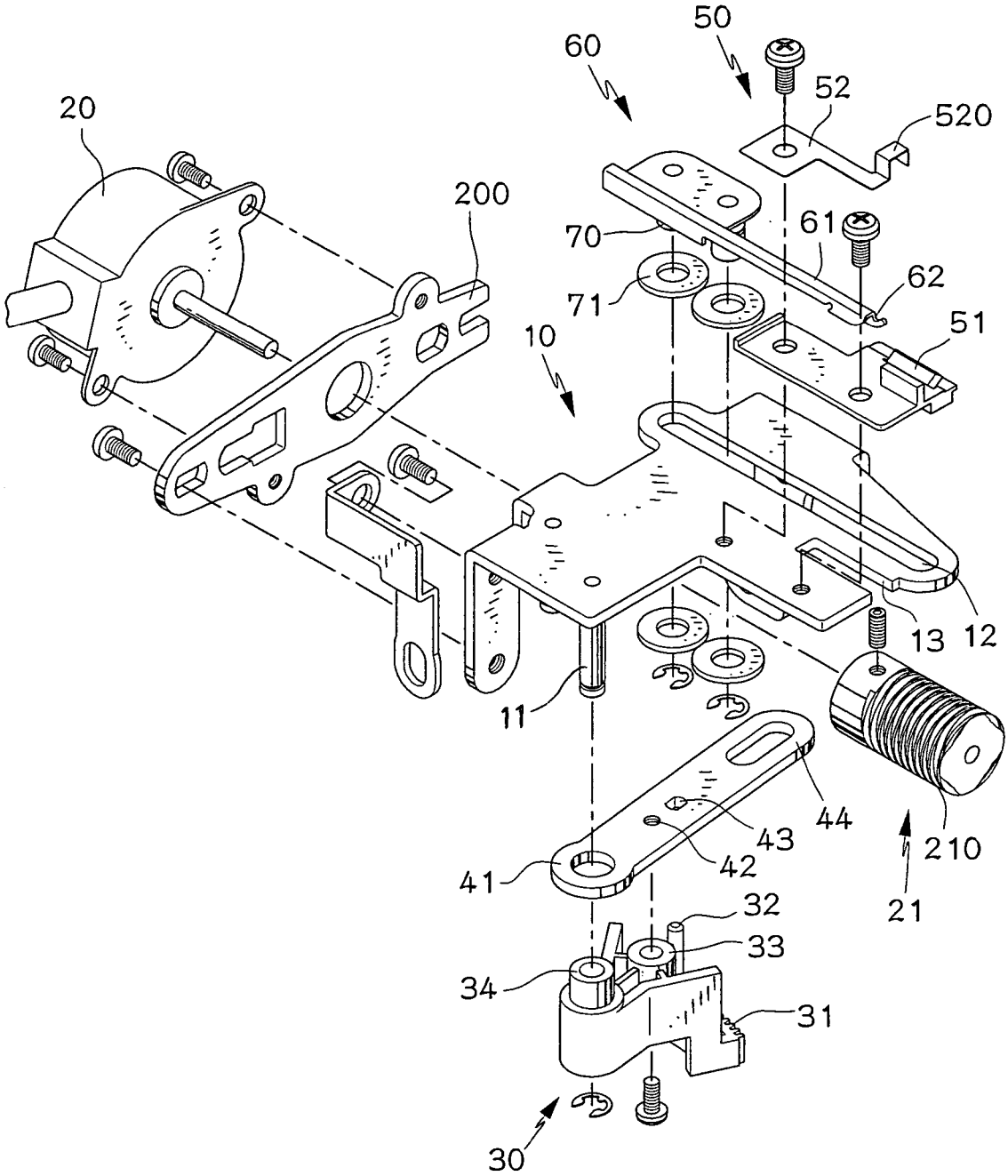
FIG. 2 is an exploded view of FIG. 1.
Figure 3:
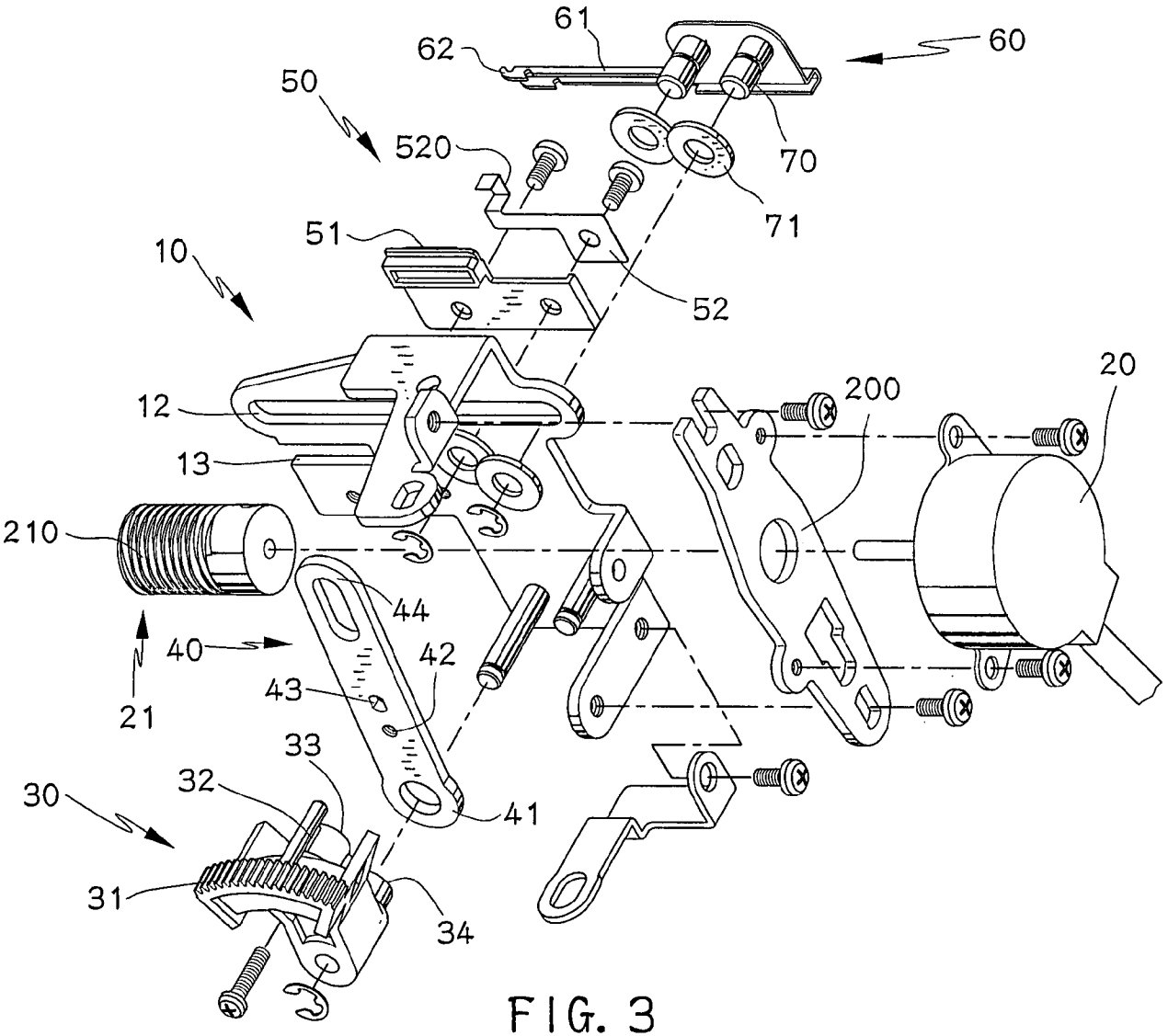
FIG. 3 is an exploded view of FIG. 1 from another angle.

Referring to FIGS. 1 to 3, an automatic thread cutting device of the present invention includes a main body 10 that is equipped with an active piece 21 actuated by a driving piece 20, wherein the active piece 21 is engaged with a passive piece 30 that coaxially motivates an interlocking piece 40. One end of the interlocking piece 40 is connected to a thread hooking member 60 and with a knife base 50 to hold the thread hooking member 60 in position. A knife 51 on the knife base 50 is used for cutting the needle thread. The thread hooking member 60 is moved along a fixed guiding structure, and then the high stability, safety and reasonableness design is achieved and the function is improved.

The main body 10 is in the form of a plate bent into U shape and directly fixed on the corresponding structure of the sewing machine for cutting the needle thread. One side of the main body 10 has screw holes for connecting a holder 200 with the driving piece 20. The driving piece 20 is a servomotor, when energized it will rotate rapidly according to different signals. The center of the driving piece 20 penetrates the holder 200 and is connected to the active piece 21 which is in the form of a cylinder and has an active part 210 in the form of a worm gear rod on the outside, the active part 210 is engaged with a passive part 31 in the form of a worm gear denture of the passive piece 30.

The passive piece 30 is in the shape of sector, which includes a passive part 31 engaged with the active piece 21 on the end of sector; a bar of position member 32 penetrated the interlocking piece 40 near the passive part 31; a fixing member 33 with a penetrating hole on the middle portion of the passive piece 30; and a pivot part 34 with a penetrating hole on the end of the passive piece 30. The main body 10 has a rod of pivot 11 to pivotally connect with the pivot part 34.

The interlocking piece 40 is in the shape of elongated plate, which includes a penetration of pivot part 41 on the end relative to the pivot part 34 of the passive piece 30; a fixing part 42 in the form of a screw hole and a position part 43 in the form of a penetrating hole on the middle portion of the interlocking piece 40 relative to the fixing member 33 and the position member 32, with a fastening piece 420 in the form of a bolt to fasten the fixing member 33 to the fixing part 42 so as to connect the interlocking piece 40 and the passive piece 30 together; and an interlocking part 44 in the form of a long hole on the end relative to the thread hooking member 60.

The knife base 50 is in the form of a plate, which is fixed on the main body 10 with a screw and has a knife 51 stretched out vertically to the thread hooking member 60. A knife holder 52 in the form of a flake is provided above the knife 51 and fixed together with the knife base 50 on the main body 10. The knife holder 52 extends a U-shaped holding part 520 on the position of the thread hooking member 60 and the knife 51 to hold the thread hooking member 60.

The main body 10 has a guiding part 12 in the form of a slot on the position relative to the thread hooking member 60 for a guiding piece 70 in the form of a guiding bar to penetrate, wherein the guiding piece 70 is integrally formed with the thread hooking member 60. The number of the guiding piece 70 may be several to the effect that the thread hooking member 60 can be moved in parallel within the guiding part 12. Furthermore, the main body 10 has a recess part 13 to accommodate the protrusion of the knife base 50.

The thread hooking member 60 is arranged on one end of the main body 10 and equipped with at least two guiding pieces 70, with restricting pieces 71 in the form of washers, the guiding pieces 70 and the thread hooking member 60 are set on the guiding part 12 of the main body 10 and moved along the guiding part 12. The interlocking part 44 of the interlocking piece 40 is set to one of the guiding pieces 70 to drive the thread hooking member 60. The thread hooking member 60 extends a reverse U-shaped extending part 61 that accommodates the knife 51 of the knife base 50 inside, and outside of the extending part 61 is restricted by the holding part 520 of the knife holder 52 to guide the extending part 61. The extending end of the thread hooking member 60 is formed a hook of thread hooking part 62 for hooking the needle thread to the cutting position.

Figure 4:
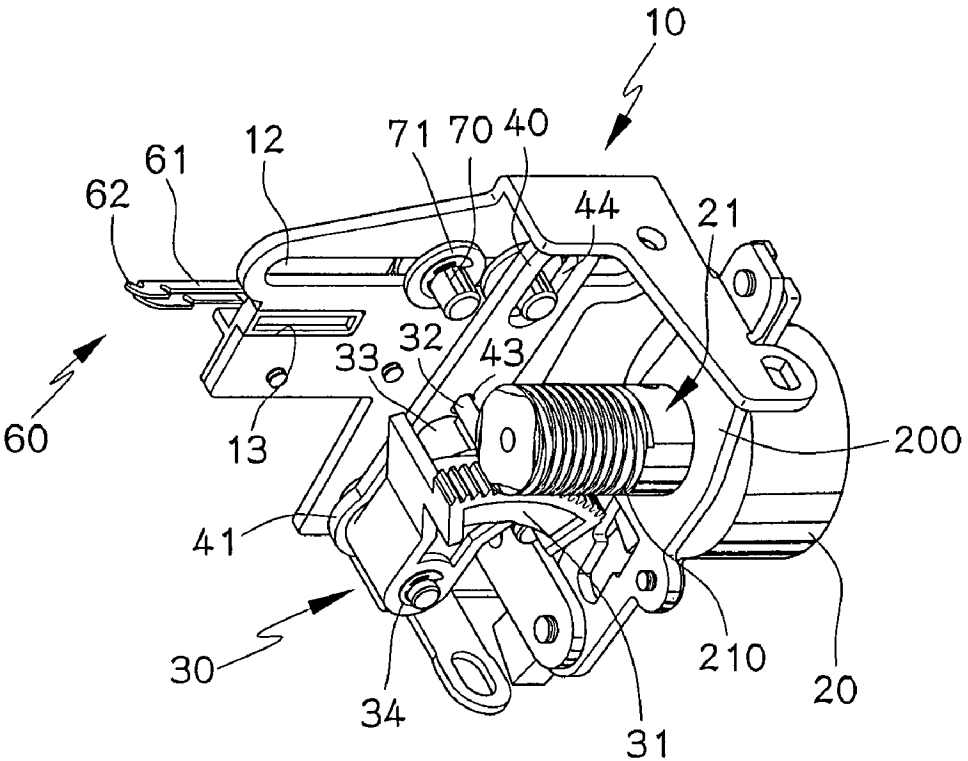
FIG. 4 is a perspective view of the present invention from another angle.
Figure 5:
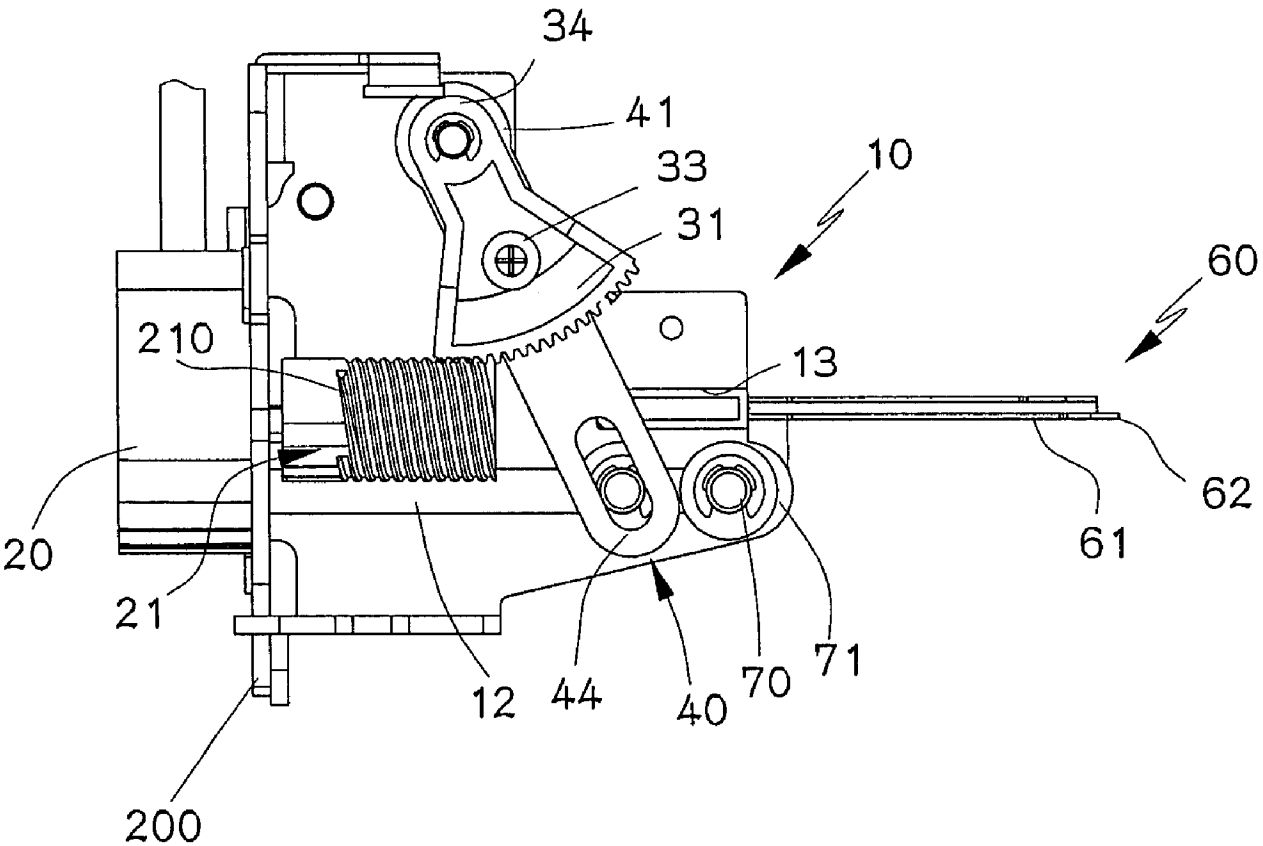
FIG. 5 is a plane view showing the thread hooking member being stretched out.
Figure 6:
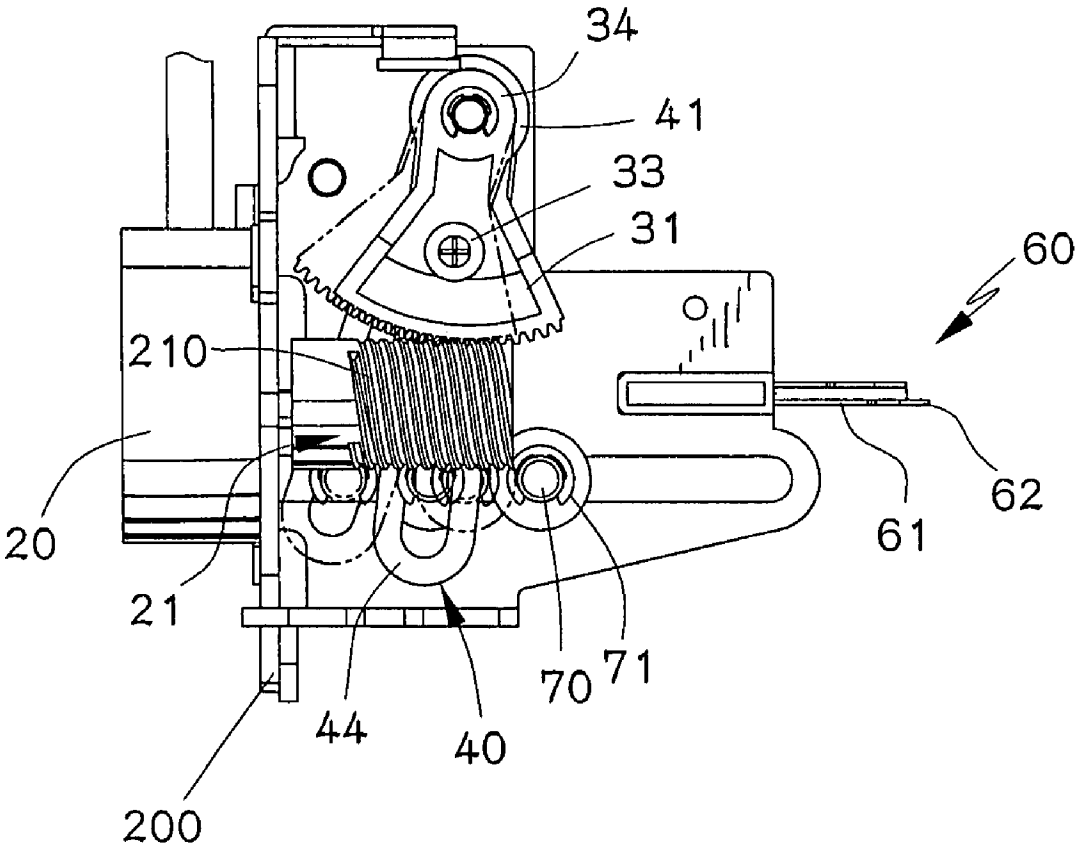
FIG. 6 is a plane view showing the thread hooking member being retracted.

Referring to FIGS. 1, 4 and 5, the thread hooking part 62 of the thread hooking member 60 is stretched outward to the position of the needle thread, at this moment, the passive part 31 of the passive piece 30 and the active part 210 of the active piece 21 are engaged at the middle portion. To retract the thread hooking part 62, the rotation of the active part 210 shall be reversed so that the passive part 31 is moved toward the driving piece 20, meanwhile the interlocking piece 40 will pull the thread hooking member 60 back until the thread hooking part 62 is retracted into the holding part 520 of the knife holder 52 and at the same time the needle thread is cut by the knife 51. The objective of cutting thread can be attained as well as safety since the knife 51 is not easy to be touched from outside as shown in FIG. 6.

With the structure described above, the functions as following would be derived:

1. The size of the whole structure is minimized efficiently: with the above-mentioned components, the distance of the passive piece 30 moved by the active piece 21 is reduced efficiently, in addition, the driving piece 20 motivates the active piece 21 with cooperation of the worm gear rod of the active piece 21 and the worm gear denture of the passive piece 30, the passive piece 30 and the interlocking piece 40 can be quickly moved, since the interlocking piece 40 and the passive piece 30 are connected together and moved the same direction, the thread hooking member 60 can be motivated in the shortest distance and length, thus the size of the whole structure is minimized efficiently and the whole structure can be accommodated into the limited space of a sewing machine, therefore the size of the sewing machine can be minimized to achieve the objectives of miniaturization and convenience.

2. Optimal safety: with the design of the knife base 50, when the thread hooking member 60 is retracted, the thread hooking part 62 is covered by the corresponding structure of the knife base 50, which is unable to be touched directly from outside, so as to improve the safety.

3. The stability of the movement about the thread hooking member 60 is improved: with the guiding part 12 of the main body 10, the holding part 520 holding the outside of the thread hooking member 61 and the knife 51 installed on the inside of the thread hooking member 61, the thread hooking member 60 is guided by multiple guiding structures, therefore to improve the stability of the movement.

4. It is more convenient to adjust the moving distance of the thread hooking member 60: the moving distance for the thread hooking member 60 can be adjusted by changing the number of rotation of the driving piece 20, furthermore, the engaging position of the active piece 21 and the passive piece 30, or the position of the guiding piece 70 mounted by the interlocking piece 40, it is not necessary to control by electricity, therefore it is more convenient and fast to adjust.

While we have shown and described the embodiment in accordance with the present invention, it should be clear to those skilled in the art that further embodiments may be made without departing from the scope of the present invention.

What is claimed is:

1. An automatic thread cutting device of a sewing machine comprising:

a main body;

an active piece;

a driving piece;

a passive piece;

an interlocking piece;

a thread hooking member; and a knife;

wherein said active piece being droved by said driving piece and engaging with said passive piece which motivating said interlocking piece, and said interlocking piece actuating said thread hooking member, said knife cooperating with said thread hooking member to cut a needle thread;

said active piece having a worm gear rod of active part, said active piece being actuated by said driving piece and engaging with said passive piece;

said passive piece having a passive part relative to the active part of said active piece and motivating said thread hooking member; and said knife equipping on a moving course of said thread hooking member.

2. The automatic thread cutting device of a sewing machine as claimed in claim 1, wherein said driving piece drives said active piece which has a worm gear rod of active part, said passive piece includes a passive part which is engaged with said active part.

3. The automatic thread cutting device of a sewing machine as claimed in claim 1, wherein said passive piece includes a passive part which is engaged with said active piece, one end of said passive piece is pivotally fixed with and moved together with said interlocking piece.

4. The automatic thread cutting device of a sewing machine as claimed in claim 3, wherein said passive piece includes a position member which can penetrate said interlocking piece, a fixing member on intermediate portion of said passive piece and a pivot part on one end of said passive piece, said main body has a pivot to pivotally connect with said pivot part.

5. The automatic thread cutting device of a sewing machine as claimed in claim 4, wherein said interlocking piece includes a pivot part on one end relative to said pivot part of said passive piece, a fixing part and a position part on intermediate portion of said interlocking piece relative to said fixing member and said position member, with a fastening piece to fasten said fixing member to said fixing part, and a interlocking part on one end relative to said thread hooking member.

6. The automatic thread cutting device of a sewing machine as claimed in claim 1, wherein said knife is provided on a knife base which is fixed on said main body, and said knife of said knife base is stretched out vertically to said thread hooking member.

7. The automatic thread cutting device of a sewing machine as claimed in claim 1, wherein said main body has a guiding part relative to said thread hooking member which has at least one set of guiding piece.

8. The automatic thread cutting device of a sewing machine as claimed in claim 1, wherein said thread hooking member is arranged on one end of said main body and has at least one set of guiding piece, said guiding piece is mounted by a restricting piece which is in form of a washer and a interlocking part of said interlocking piece is mounted to one of said guiding piece.

9. The automatic thread cutting device of a sewing machine as claimed in claim 1, wherein said thread hooking member extends an extending part which accommodates said knife inside and one end of said thread hooking member is formed a thread hooking part for hooking a needle thread.

10. The automatic thread cutting device of a sewing machine as claimed in claim 1, wherein said thread hooking member relative to said knife is restricted by a knife holder which is fixed on said main body and has a holding part for restricting said thread hooking member.

11. The automatic thread cutting device of a sewing machine as claimed in claim 1, wherein an interlocking piece is provided between said passive piece and said thread hooking member.

12. The automatic thread cutting device of a sewing machine as claimed in claim 11, wherein said passive piece includes a position member toward said interlocking piece, a fixing member on the intermediate portion of said passive piece, and a pivot part on one end of said passive piece, said main body has a pivot to pivotally connect with said pivot part.

13. The automatic thread cutting device of a sewing machine as claimed in claim 12, wherein said interlocking piece includes a pivot part relative to said pivot part of said passive piece, a fixing part and a position part relative to said fixing member and said position member, with a fastening piece to fasten said fixing member to said fixing part, and a interlocking part on the end relative to said thread hooking member.

14. The automatic thread cutting device of a sewing machine as claimed in claim 1, wherein said active piece is fixed on a main body which includes a pivot to pivotally connect with said passive piece and a guiding part on a moving course of said thread hooking member which has at least one set of guiding piece.

15. The automatic thread cutting device of a sewing machine as claimed in claim 1 or 14, wherein said knife is provided on a knife base which is fixed on said main body, and said knife of said knife base is stretched out vertically to said thread hooking member.

16. The automatic thread cutting device of a sewing machine as claimed in claim 15, wherein said main body has a recess part to accommodate a protrusion of said knife base.

17. The automatic thread cutting device of a sewing machine as claimed in claim 1 or 14, wherein said thread hooking member is arranged on one end of said main body and has at least one set of guiding piece, said guiding piece is mounted by a restricting piece which is in form of a washer and a interlocking part of an interlocking piece is mounted to one of said guiding piece.

18. The automatic thread cutting device of a sewing machine as claimed in claim 1, wherein said thread hooking member extends an extending part which accommodates a knife inside and one end of said thread hooking member is formed a thread hooking part for hooking a needle thread.

19. The automatic thread cutting device of a sewing machine as claimed in claim 15, wherein said knife base or said knife has a knife holder that extends a holding part to the place of said thread hooking member and said knife.

* * * * *